United States Patent [19]

Gladden et al.

[11] Patent Number: 4,923,672

[45] Date of Patent: May 8, 1990

[54] METHOD OF OBTAINING A MOULD INTENDED FOR THE MANUFACTURE OF VERY SMALL PARTS

[75] Inventors: Thomas Gladden, Cormondrèche; Fritz Füllemann, Granges, both of Switzerland

[73] Assignee: ETA SA Fabriques d'Ebauches, Switzerland

[21] Appl. No.: 284,030

[22] Filed: Dec. 14, 1988

[30] Foreign Application Priority Data

Dec. 16, 1987 [FR] France ..... 8717695

[51] Int. Cl.[5] ..... B22F 1/00

[52] U.S. Cl. ..... 419/18; 419/17; 419/36; 419/37

[58] Field of Search ..... 419/18, 36, 37, 17; 428/552; 75/236; 249/135; 264/111

[56] References Cited

U.S. PATENT DOCUMENTS

| | | | |
|---|---|---|---|
| 4,174,364 | 11/1979 | Balosetti | 419/2 |
| 4,431,449 | 2/1984 | Dillon et al. | 75/246 |
| 4,526,747 | 7/1985 | Schimmel et al. | 419/8 |
| 4,657,822 | 4/1987 | Goldstein | 428/552 |

FOREIGN PATENT DOCUMENTS

| | | |
|---|---|---|
| 0233478 | 8/1987 | European Pat. Off. . |
| 2558710 | 4/1977 | Fed. Rep. of Germany . |
| 8101972 | 7/1981 | Int'l Pat. Institute . |
| 426600 | 4/1935 | United Kingdom . |

*Primary Examiner*—Stephen J. Lechert, Jr.
*Assistant Examiner*—Nina Bhat
*Attorney, Agent, or Firm*—Pollock, Vande Sande & Priddy

[57] ABSTRACT

The mould of this invention is intended for the manufacture of small dimensioned parts, in particular those dimensioned on the order of 0.1 mm or less. It comprises one or several mould shells each of which is obtained by:

- machining a matrix (100) from a hard material of which at least a portion (104) will have the form of a negative of the desired shell, such portion having dimensions slightly greater than those of the shell to be finally obtained;
- positioning the matrix within a cavity (106) and obtaining a blank of the shell (116) by injecting a mixture composed of a metallic powder and a binding agent into the cavity;
- eliminating the binding agent by heating the blank and thereafter subjecting said blank to a sintering operation.

10 Claims, 5 Drawing Sheets

METHOD OF OBTAINING A MOULD INTENDED FOR THE MANUFACTURE OF VERY SMALL PARTS

This invention concerns a method of obtaining a mould intended for the manufacture of very small dimensioned parts, i.e. parts one of the dimensions of which does not exceed some millimeters.

BACKGROUND OF THE INVENTION

In particular, the invention is applicable to horology in order to obtain moulds intended for manufacturing by injection magnetic rotors for the motor assemblies of quartz watches. It is likewise applicable for obtaining moulds for the manufacture of parts by swaging.

In the description to follow, there will be considered by way of example the obtaining of a mould for manufacture of magnetic rotors for quartz watches. However, it is well understood that the invention is not to be considered as limited to this particular mould, but may apply to the obtaining of moulds of any form whatsoever intended for the manufacture of any small dimensioned parts whatsoever.

A magnetic rotor for a quartz watch comprises a magnet in the form of a disc and a part which is injection moulded. This part comprises a housing of generally cylindrical form providing a casing for the magnet, an upper axis including a pinion, a step and a pivot, and a lower axis including a step and a pivot. The magnetic rotor has an axial length of about 3 mm:. and a diameter, for the housing, of about 2 mm. The diameter of the pinion is generally between 0.5 mm. and 1 mm. and the pivots have a diameter on the order of 0.1 mm.

The magnetic rotor is obtained by injection moulding. According to the prior art, the mould may be formed in a metal block by techniques such as spark machining or electro-erosion.

The cutting precision available with these techniques is sufficient to obtain a mould of small dimensions such as the cavity form of a leaf of the pinion of the magnetic rotor. However, it is possible by such techniques to obtain only a simple profile for this cavity form such as for example a profile made up of a series of line segments.

It is known that pinion leaves are generally of complex profiles, for instance of the hypocycloid type in order to permit improved meshing. There thus exists an unsolved problem using known techniques.

The purpose of the invention is to provide a solution to this problem. In particular the invention enables obtaining moulds intended for manufacturing magnetic rotors for quartz watches comprising pinion leaves having a complex profile for a pinion with a diameter less than 1 mm. Generally, the invention aims to obtain moulds for the manufacture of parts of very small dimensions comprising complex profiles and of a size not exceeding some tenths of a millimeter.

The method of the invention consists in obtaining the mould from a powder comprising at least one metal (designated as "metallic powder" in the rest of the description) which is formed by moulding on a matrix having the form of the parts to be manufactured and then sintered.

The method of the invention is totally different from the known method consisting of obtaining the parts from a sintered metallic powder. Effectively, the invention resides in the fact that it obtains a negative of the mould by machining a matrix, then forms a negative of said matrix in order to obtain the mould. This double operation enables the determination of the form of the mould on a part in relief—the matrix—which may be easily worked on while, according to the prior art, the mould is directly obtained as a cavity by hollowing out a part.

SUMMARY OF THE INVENTION

More precisely, the object of the invention comprises a method of obtaining a mould intended for manufacturing parts of very small dimensions, such mould comprising one or several mould shells adapted to be assembled so as to define a cavity having the form and dimensions of the parts to be manufactured wherein the obtaining of each shell comprises the steps of:

- machining a matrix in a hard material at least one part of which takes the form of a negative of the desired shell, this part having dimensions slightly greater than those of the shell to be obtained;
- positioning the matrix in a cavity and obtaining a blank of the shell by injecting a mixture composed of a metallic powder and a binding agent into the cavity;
- removing the binding agent by heating and subjecting the blank to a sintering operation.

In the method of the invention, the matrix employed in order to obtain the mould has dimensions greater than those of the parts which will be ultimately manufactured in order to take into account the shrinkage which the shell undergoes during the sintering operation. It is known that the shrinkage may be precisely determined by the respective proportions of the binding agent and the metallic powder. In the preferred manner, one provides a matrix corresponding to a shell with dimensions greater by 5% to 25% than those of such shell.

The use of a matrix to define the mould enables one to employ techniques such as profile turning which offers the advantage of enabling one to attain a better resolution than spark machining or electro-erosion. An increase in resolution is moreover obtained through the simple fact that the matrix has dimensions greater than those of the parts to be obtained. The method of the invention thus enables the obtaining of patterns of small dimensions with complex profiles.

The characteristics and advantages of the invention will be better understood from the description to follow given by way of illustration but not intended to be limiting in having reference to the accompanying drawings in which:

DESCRIPTION OF THE PREFERRED EMBODIMENT

Figure 1A:
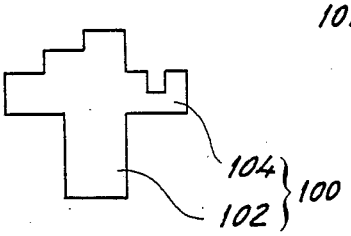
FIGS. 1*a* to 1*d* illustrate the different stages of the method of the invention and FIG. 1*e* illustrates the employment of the mould obtained according to this method to manufacture parts of small dimensions.
Figure 1B:
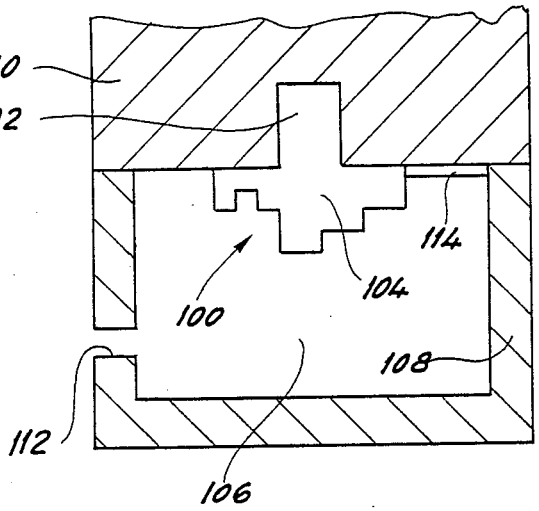

FIGS. 1*a* to 1*d* show the successive stages of the method of the invention for the case of a mould obtained from a single matrix. The first stage consists in forming a matrix 100 such as shown on FIG. 1*a* comprising a support 102 and a portion 104 having the form of the parts to be manufactured and dimensions slightly greater than such parts. Matrix 100 is preferably obtained by machining from a block of hard material such as steel.

The second stage of the method consists in obtaining a blank of the mould from this matrix. In order to do so, as has been shown in FIG. 1*b*, part 104 of matrix 100 is placed in a cavity which is defined by the assembly of two elements 108 and 110. The matrix 100 is maintained in the cavity by its support 102. An orifice 112 provided in the element 108 enables injection into the cavity of the mixture formed of the metallic powder and the binding agent.

Figure 1C:
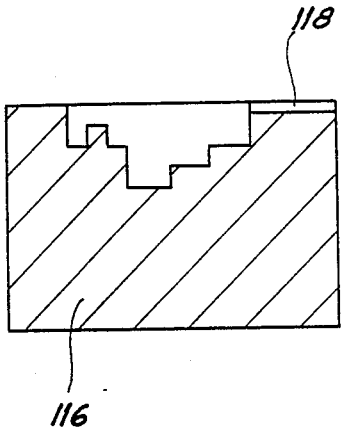

One thus obtains a mould blank 116 such as shown FIG. 1*c*. The channel 118 may be provided in this mould by machining or by placing in cavity 106 a stem 114 between matrix 100 and the edge of the cavity. Such stem may form an integral part of matrix 100 or be formed by a surface protuberance of element 110.

Figure 1D:
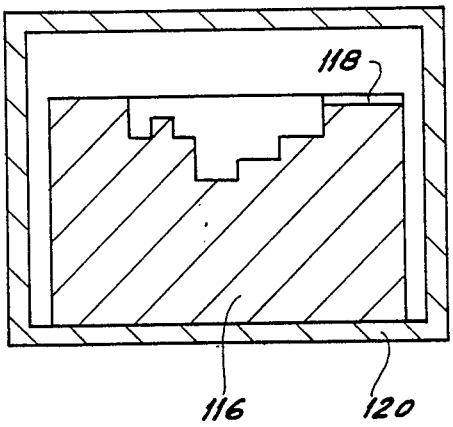

The third stage of the method is shown in FIG 1*d* which shows the mould blank 116 in an oven 120. In this stage the binding agent is eliminated by heating, then the mould blank is sintered. The shrinkage undergone by the mould blank in the course of this stage compensates the initially greater dimension of the mould brought about by the difference in dimensions between the matrix and the parts to be manufactured.

Figure 1E:
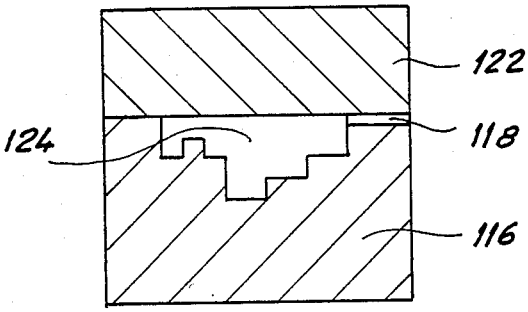

FIG. 1*e* shows use of the mould obtained according to the method of the invention. The mould 116 is assembled with a cover 122 so as to form a cavity 124 having the form and the dimensions of the parts to be manufactured. The gate or channel 118 enables injection into this cavity of the material employed for the manufacture of the parts.

There will now be described, by way of example, the obtaining according to the method of the invention, of a mould intended for the manufacture of magnetic rotors for quartz watches.

Figure 2A:
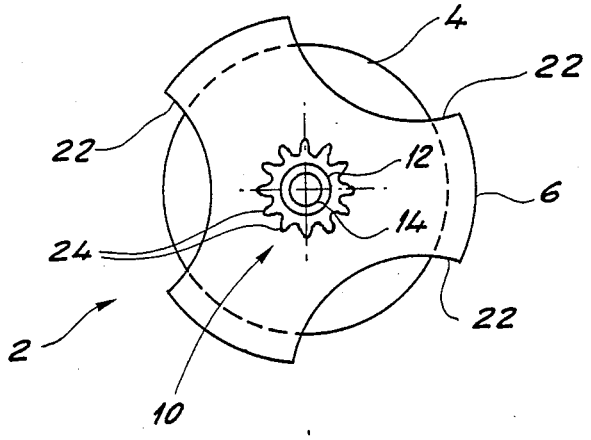
FIGS. 2*a* and 2*b* show respectively a top view and a face view of a magnetic rotor for a quartz watch, such magnetic rotor comprising a magnet arranged in a moulded part.
Figure 2B:
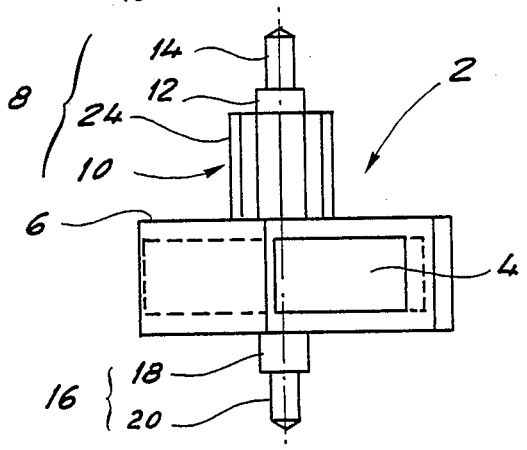

Such magnetic rotor is shown in FIGS. 2*a* and 2*b* on which it is designated by reference numeral 2.

It comprises a magnet 4 having the form of a disc and a moulded portion including three parts: a housing 6 of generally cylindrical form containing magnet 4, an upper axis 8 comprising a pinion 10, a step 12 and a pivot 14, and a lower axis 16 including a step 18 and a pivot 20. The magnet 4, the housing 6 and axes 8, 16 are aligned on a common axis. Housing 6 may comprise one or several cavities 22 which, as will be seen in the description to follow, correspond to the portions of the mould the function of which is to maintain the magnet 4 in position during moulding by injection of the rotor 2.

The magnetic rotor shown in FIGS. 2*a* and 2*b* has an axial length of about 3 mm. and a diameter of about 2 mm. Pivots 14, 20 have a diameter of about 0.1 mm.; the leaves 24 of the pinion 10 define teeth likewise having a depth on the order of 0.1 mm.

Figure 3A:
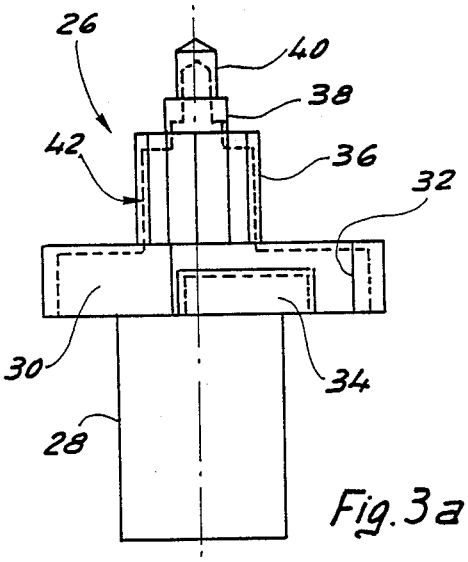
FIGS. 3*a* and 3*b* represent matrices for the obtaining of a mould formed from two shells, such mould being intended for the manufacture of the magnetic rotor shown on FIGS. 2*a* and 2*b;*
Figure 3B:
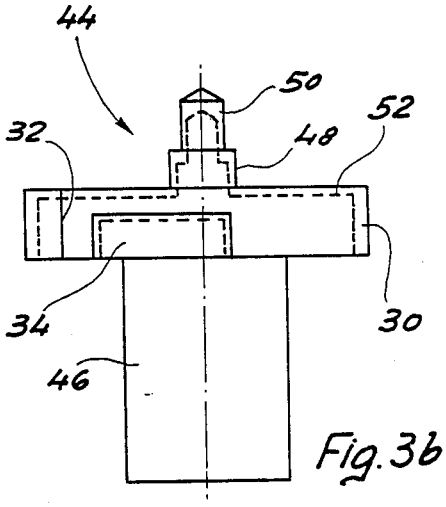

The mould intended for the manufacture of this magnetic rotor is formed, in accordance with the invention, in three stages. The first stage consists in providing one or several matrices each corresponding to a portion of the part to be manufactured. In the case of the magnetic rotor shown in FIG. 2*a* and 2*b*, there will be employed to advantage matrices such as shown in FIGS. 3*a* and 3*b*. These matrices correspond respectively to the upper and lower portion of the magnetic rotor defined relative to a plane perpendicular to the axis of the rotor and dividing the magnet 4 into two substantially equal portions.

FIG. 3*a* is a face view of a matrix 26 referred to as the upper matrix and including on a support 28 the elements corresponding to the upper half of the magnetic rotor. The upper matrix 26 is machined from a hard material, for example steel, so as to provide on the support 28 a generally cylindrically formed element 30 comprising hollows 32 and expansions 34. Element 30 has thus the outer form of the housing 6 and of the magnet 4. Onto this element 30 there will be machined a pinion 36, a step 38 and a pivot 40.

In order to take into account the shrinking of the mould during the sintering stage, upper matrix 26 is formed with dimensions slightly greater than those of the magnetic rotor to be manufactured. The ratio of the dimensions of the matrix to those of the parts to be manufactured is for example from 1.05 to 1.25 and is preferably close to 1.15. In FIG. 3*a* there has been indicated by dotted line 42 the of the magnetic rotor to be manufactured.

FIG. 3*b* shows a face view of a matrix 44 referred to as the lower matrix and corresponding to the lower half of the magnetic rotor. This matrix comprises a support 46 on which is machined an element 30 including a hollow 32 and an expansion 34 which forms the second half of housing 6 and of the magnet 4, a step 48 and a pivot 50. Just as in the case of the upper matrix 26, the lower matrix 44 is machined with dimensions slightly greater than those of the magnetic rotor to be manufactured. By way of comparison, the lower half of the magnetic rotor is shown by a dotted line 52.

Each matrix is obtained by machining a block of hard material, for instance a block of metal. The machining may be performed according to any technique known to persons skilled in the art; however, preferably, the machining of the matrices is by profile turning or any similar technique, such techniques having the advantage of enabling the obtaining of complex profiles for the pinion teeth, even when the depth of the teeth does not exceed 0.1 mm.

Forming the matrices for the part to be manufactured constitutes the first stage of the method of the invention. The following stage consists in obtaining blanks of each shell by the injection of a metallic powder into the cavities containing these matrices.

Figure 4A:
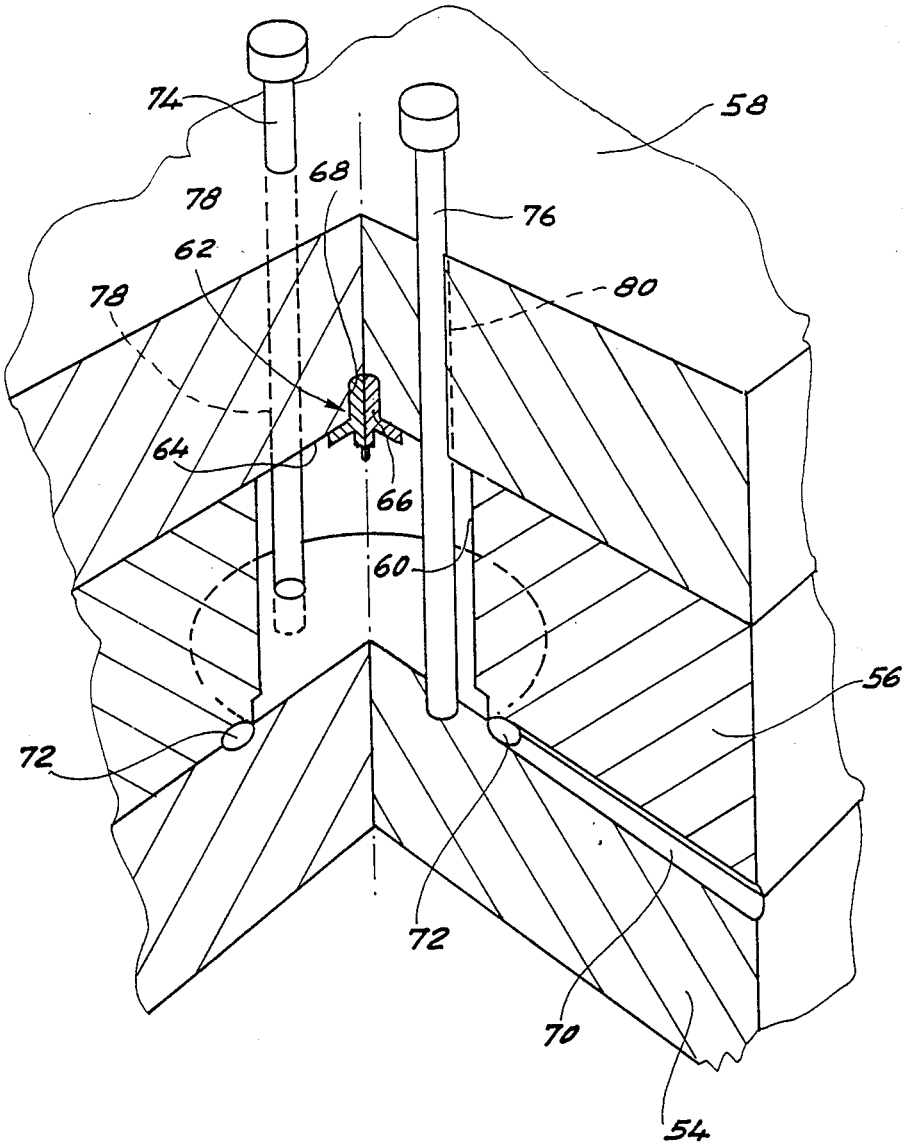
FIGS. 4*a* and 4*b* show an arrangement for obtaining by moulding, according to the invention, a blank of the shell in metallic powder, FIG. 4*a* showing the arrangement in a closed position before the moulding and FIG. 4*b* showing the arrangement after the moulding.
Figure 4B:
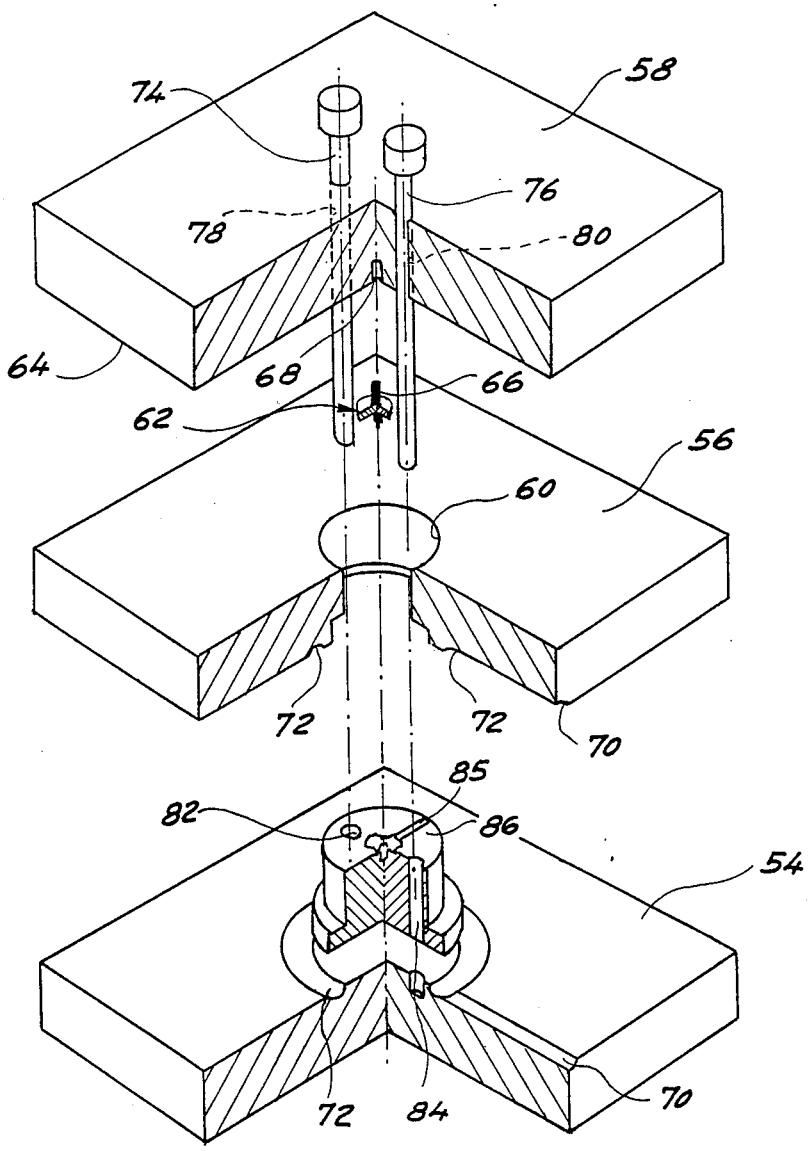

There has been shown in FIGS. 4*a* and 4*b* an arrangement for effecting the second stage of the method of the invention, respectively in the closed position prior to the injection and in the open position following the injection.

This arrangement includes basically a fixed plate 54, a movable plate 56 and a movable plate 58. Such plates are preferably formed of steel. Plate 56 may be moved in translation along an axis perpendicular to the surface of plate 54 so as to be placed on plate 54 or to be separated therefrom. In the same manner, plate 58 may be displaced along the same axis so as to come in contact with plate 56 or to be separated therefrom. The translation movement of plates 56 and 58 is guided by well-known means, not shown.

The intermediate plate 56 includes a cylindrical cavity 60 which, when the three plates are in contact as shown in FIG. 4*a*, forms the cavity in which matrix 62 is placed for obtaining a blank of the shell. The arrangement is employed successively to obtain two shell, blanks from the upper 26 and lower 44 matrices shown in FIGS. 3*a* and 3*b*.

Matrix 62 placed in the cavity is fixed to the lower face 64 of plate 58. This fastening may be brought about by suction, gluing, soldering or other means from the support 66 (respectively 28 and 46 in FIGS. 3*a* and 3*b*) and from the matrix 62 (respectively 26 and 44), the support 66 being received in a blind hole 68 provided in the lower surface 64 of plate 58.

A feed channel or gate 70 is provided for injecting into the cavity the material of which the shell blank is formed. A receiving channel 72 is provided at the base of the cavity to accommodate the excess of the injected material. The arrangement likewise comprises centering rods 74, 76 which are guided in holes 78, 80 in plate 58. Such rods pass through the cavity; as may be seen in FIG. 4*b*, such rods enable the creation within the moulded shell 86 of channels 82, 84 which may be employed as means for positioning between themselves, the different shells forming the mould. A channel 85 corresponding to channel 118 visible in FIG. 1*c* is likewise provided.

The material from which the shells are obtained comprises a metallic powder which for the injection operation is mixed with a binding agent. The dimension of the powder grains is preferably between 1 and 5 microns in order to guarantee an optimum proportion of metal in the mixture of powder and binding agent.

The material may be a metal, a semi-metal or an alloy such as a carbide, for instance a carbide of titanium or tungsten, a nitride, for instance a nitride of titanium or niobium, or a heavy metal, for instance iron, nickel, chromium or molybdenum, or an alloy of such heavy metals, or again a ceramic type material, for instance $Al_2O_3$, $ZnO_2$ or mixture of $Al_2O_3$ and of $ZnO_2$. In the case of tungsten carbide the latter is advantageously supplemented by cobalt in a proportion of 3 to 12% by weight of the mixture. In the case of titanium carbide, the latter is advantageously supplemented by nickel and/or molybdenum, likewise in a proportion of 3 to 12% by weight of the mixture.

By way of example, one may proceed in the following manner. Tungsten carbide powder of D quality furnished for instance by the Murex Company in Great-Britain having an average grain size of ca. 3.5 microns is placed during 36 hours in a crusher having a hard metal mill in the presence of a solvent such as decahydronaphthaline. From 3 to 12% by weight of pulverized cobalt is then added to the tungsten carbide powder and the mixture is thereafter milled during a further 3 to 6 hours.

The finely pulverized mixture thus obtained is next vacuum dried to eliminate the solvent, then mixed at 150° C. with a binding agent composed of 80% by weight of a hard wax of the Fischer-Tropsch type and 20% by weight of a partially saponified wax. Both of these waxes may be obtained for instance from the company Chemische Werke Hü ls in Marl in the Federal Republic of Germany under the respective references of SH105 and K25.

This mixture is then passed three times in succession in a screw-type injection press as regularly employed in the plastics material industry. The first two passages serve to effect an intimate mixing of the powder and the binding agent. During the third passage the mixture is injected in the arrangement shown in FIG. 4*a* which is maintained at a temperature of 100° C. A few seconds following this extrusion, the shell blank 86 may be withdrawn from the moulding arrangement.

The following stage consists in eliminating the binding agent and then sintering the blank.

Initially, the blank is heated to 450° C. in an oven in the presence of a protective gas or under vacuum. The binding wax is almost completely eliminated during this heating by liquefaction and evaporation. During the heating one may place the blank on a support formed of material adapted to absorb the binding agent, for instance a sheet of fiberglass or one may surround it completely with an absorbing substance such as powdered aluminum oxide. This heating is carried out over a time period on the order of several hours and which depends on the dimensions of the article.

In a second phase the blank is placed in a sintering furnace and heated under vacuum so as to eliminate any remaining binding agent as well as gases or water vapour which it could have absorbed.

The blank is next heated to a temperature of 700° C. under vacuum, i.e. at a pressure of about 0.1 millibar, then to a temperature of 1400° C. in an argon atmosphere at a pressure of 100 millibar. The blank is maintained at this temperature for about 30 minutes.

After cooling, the blank thus obtained is ready for use and requires no further machining.

Figure 5:
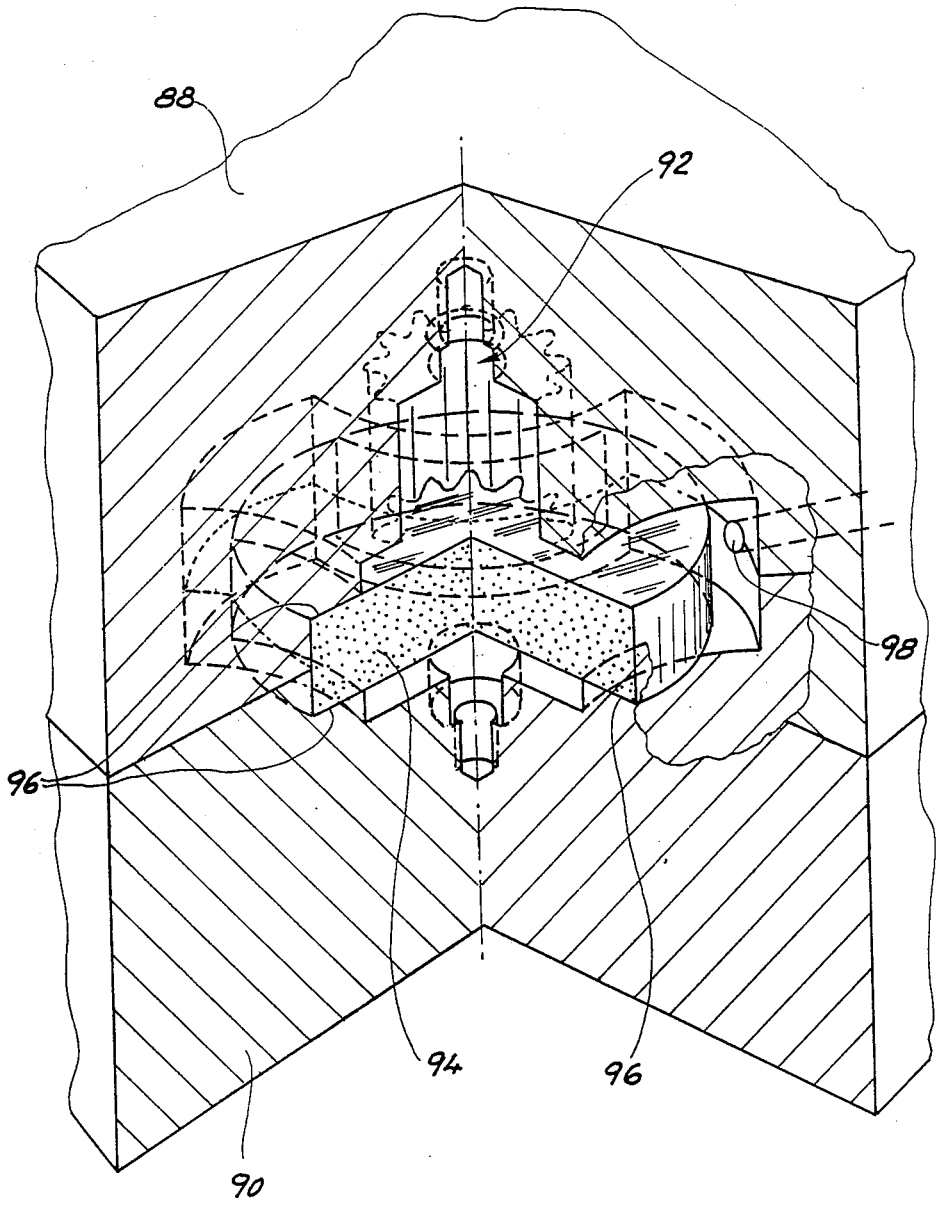
FIG. 5 is a cross-section showing the manufacture of a magnetic rotor by injection moulding in the mould obtained according to the method of the invention.

FIG. 5 illustrates a mould composed of two shells made according to the method of the invention. Shells 88, 90 correspond respectively to the matrices 26, 44 shown in FIGS. 2*a* and 2*b*. When assembled, these shells define a cavity 92 having the form and the dimensions of the magnetic rotor illustrated in FIGS. 2*a* and 2*b*.

To manufacture the magnetic rotor one places initially the magnetized disc 94 in the lower shell 90 and the mould is closed by putting in place the upper shell 88. The magnetized disc 94 is automatically held in position when the mould is closed because of the shoulders 96 which correspond—as a negative—to the cavities 22 of the housing 6 as seen in FIGS. 2*a* and 2*b*. Next there is injected into the mould the material chosen for the manufacture of the magnetic rotor, for instance a plastic material, via at least one nozzle 98 formed at the intersection of the two shells 88, 90 and formed of two channels such as channel 85 visible in FIG. 4*b*.

The invention concerns the obtaining of the mould itself and not a particular method for the manufacture of parts by injection. It is thus unnecessary to set forth in detail the materials and operating conditions which may be chosen for the manufacture of these parts, such being chosen among the materials and operating conditions known as a function of the nature and the use of these parts.

What we claim is:

1. In a process of obtaining a mould intended for the manufacture of very small dimensioned parts, said mould comprising one or several mould shells adapted to be assembled so as to define a part moulding cavity having the form and dimensions of the parts to be manufactured, a method for the obtaining of each shell comprising the steps of:

machining a matrix from a hard material of which at least a portion has the form of a negative of the desired shell, such portion having dimensions slightly greater than those of the shell to be obtained;

positioning said matrix in a blank forming cavity and obtaining a blank of the shell by injecting into said cavity a mixture containing a binding agent and a powder comprising at least one metallic element;

removing said matrix from said cavity; and, eliminating the binding agent from said blank by heating and subjecting said blank to a sintering operation, said sintering operating causing said blank to shrink and form said mould shell such that the portion of said part moulding cavity to be provided by said mould shell has the form and dimensions of the corresponding portion of the small parts to be moulded therein.

2. A method as set forth in claim 1 wherein the proportions of binding agent and powder in the mixture are determined for each shell as a function of the dimensional spread between the corresponding matrix and the parts to be manufactured.

3. A method as set forth in claim 1 or in claim 2 wherein for each shell the corresponding matrix is of dimensions from 5% to 25% greater than those of the shell to be obtained.

4. A method as set forth in claim 1 or claim 2 wherein the metallic powder is composed of tungsten carbide and cobalt.

5. A method as set forth in claim 1 or claim 2 wherein said metallic powder is composed of titanium carbide and or nickel and/or of molybdenum.

6. A method as set forth in claim 1 or claim 2 wherein the binding agent is of plastic material.

7. A method as set forth in claim 1 wherein each matrix is formed by profile turning.

8. A method as set forth in claim 1 wherein the matrices are formed of steel.

9. In a process for obtaining a mould intended for the manufacture of small parts by injection, a method as set forth in claim 1 further comprising the additional step of providing at least one matrix with an element in the form of a stem, said stem(s) defining in the finished shell a gate for injection moulding said small parts.

10. A method as set forth in claim 1 wherein another portion of said matrix has the form of a support for maintaining said matrix in position in said blank forming cavity.

* * * * *